US009445699B2

(12) United States Patent
Mangrum, Jr.

(10) Patent No.: US 9,445,699 B2
(45) Date of Patent: Sep. 20, 2016

(54) LOW POWER TOILET LIGHT ILLUMINATOR AND NIGHT LIGHT WITH PHOTOSENSOR ACTIVATION

(71) Applicant: Charlie Mangrum, Jr., Las Vegas, NV (US)

(72) Inventor: Charlie Mangrum, Jr., Las Vegas, NV (US)

( * ) Notice: Subject to any disclaimer, the term of this patent is extended or adjusted under 35 U.S.C. 154(b) by 0 days.

(21) Appl. No.: 14/704,847

(22) Filed: May 5, 2015

(65) Prior Publication Data

US 2015/0316250 A1 Nov. 5, 2015

Related U.S. Application Data

(60) Provisional application No. 61/988,652, filed on May 5, 2014.

(51) Int. Cl.

| | |
|---|---|
| ***A47K 13/24*** | (2006.01) |
| ***F21V 33/00*** | (2006.01) |
| ***F21V 23/04*** | (2006.01) |

(52) U.S. Cl.

CPC ..... *A47K 13/24* (2013.01); *F21V 23/04* (2013.01); *F21V 23/0464* (2013.01); *F21V 23/0471* (2013.01); *F21V 23/0485* (2013.01); *F21V 23/0492* (2013.01); *F21V 33/004* (2013.01)

(58) Field of Classification Search

CPC ..... F21V 23/04; F21V 23/0464; F21V 23/0471; F21V 23/0485; F21V 23/0492; F21V 33/004; A47K 13/24; A47K 13/30

USPC ..... 362/101

See application file for complete search history.

(56) References Cited

U.S. PATENT DOCUMENTS

| | | | | | |
|---|---|---|---|---|---|
| 4,413,364 | A * | 11/1983 | Bittaker | A47K 17/00 | 362/131 |
| 4,736,471 | A * | 4/1988 | Johnson | A47K 13/24 | 4/234 |
| 4,860,178 | A * | 8/1989 | Picon | E03D 9/00 | 362/101 |
| 5,003,648 | A * | 4/1991 | Anderson | A47K 13/30 | 4/314 |
| 5,036,443 | A * | 7/1991 | Humble | F21V 33/004 | 136/291 |
| 5,276,595 | A * | 1/1994 | Patrie | A47K 13/30 | 362/101 |
| 5,437,066 | A * | 8/1995 | Mills | A47K 13/24 | 362/191 |
| 5,664,867 | A * | 9/1997 | Martin | F21V 33/004 | 340/686.1 |
| 5,748,096 | A * | 5/1998 | Kaufer | A47K 13/24 | 340/686.1 |
| 5,926,867 | A * | 7/1999 | Buchanan | A47K 13/24 | 353/43 |
| 6,203,164 | B1 * | 3/2001 | Tufekci | A47K 13/24 | 362/101 |
| 8,398,257 | B1 * | 3/2013 | Paulus | F21V 33/004 | 362/101 |
| 2004/0184273 | A1 * | 9/2004 | Reynolds | A47K 13/24 | 362/394 |
| 2011/0267201 | A1 * | 11/2011 | Bucha | F21V 33/004 | 340/686.1 |
| 2012/0068613 | A1 * | 3/2012 | Veneto | A47K 13/24 | 315/159 |
| 2014/0250578 | A1 * | 9/2014 | Murphy | A47K 13/24 | 4/420 |

* cited by examiner

*Primary Examiner* — Laura Tso
(74) *Attorney, Agent, or Firm* — Donn K. Harms

(57) ABSTRACT

A toilet illumination device engageable with a toilet seat is provided which illuminates the toilet and proximal area in low ambient light or darkness. The device is battery powered and utilizes light emitters such as LED's to provide a low energy light source to assist users in locating and using the toilet upon awakening in the night. The device may emit light in a spectrum or lumen level known to not significantly interfere with user's falling back to sleep due to the low light and color characteristics of the light emitting diodes. The device once activated in low light conditions and may illuminate a plurality of light emitting diodes when the seat is lifted and or lowered without the need to turn on bathroom lights or other brighter and more energy consuming light sources.

11 Claims, 4 Drawing Sheets

LOW POWER TOILET LIGHT ILLUMINATOR AND NIGHT LIGHT WITH PHOTOSENSOR ACTIVATION

BACKGROUND OF THE INVENTION

1. Field of the Invention

This application claims priority to U.S. Provisional Application Ser. No. 61/988,652 filed on May 5, 2014, which is included herein in its entirety by this reference thereto.

The present invention relates to an improved device for the illumination of toilets. More particularly, it relates to a device which is operatively engageable with the underside of a toilet seat to thereafter provide illumination in dark environments while concurrently preserving the night vision of users. The device facilitates the location and use of toilets in dark environments while saving energy and allowing a user to easily return to sleep having not encountered bright lighting known to interrupt sleep patterns.

2. Prior Art

Due to the inevitability of occasionally awakening during the night to use the restroom, visits to the toilet in dark and poorly lit environments continue as a common occurrence in the United States and throughout the world. Currently, to avoid stumbling and tripping over unseen objects, individuals may turn on their main bathroom light fixtures to use the restroom in the middle of the night. This sudden bright light can be extremely disorienting, can cause subsequent sight returning to a darkened room to be impaired, and as has been indicated, such bright light can have a brain reaction and cause unnecessary difficulty in returning to sleep.

In addition to the potentially painful and temporarily blinding experience resulting from the use of main bathroom light fixtures, is the potential difficulty of locating and operating the manual switch required to turn on the light fixture in a semi-conscious, fatigued state under unfavorable visual conditions. This searching in the dark can create a potential hazard for those who may also be in a rush to relieve themselves and return to bed.

There exists in prior art numerous attempts at circumventing these obstacles that hinder a users ability to locate and use toilets in low ambient light situations. One such example is described in U.S. Pat. No. 3,982,288 (Borne) where a toilet seat is configured at manufacture to serve as a night light. In Borne, a lamp is used to illuminate a LUCITE rod cast permanently within a seat's center until the seat is lifted, whereupon the lamp is deactivated. While this solution allows an individual to locate the toilet in the dark, it is only usable with new construction or the replacement of an existing toilet seat and appears inadequate for male use due to the system deactivation upon elevating the seat.

The Borne system also appears to have shortcomings in the cost and installation requirements as most homeowners, renters or toilet users would rather not dispose of a working seat and purchase a new one which requires integrated LUCITE and lamp components that potentially require high voltage AC current for use. Further, the ongoing running of an electrical transformer and employment of resistance based light bulbs are not energy efficient as a 12 volt bulb and continually running transformer use significant amounts of electrical energy over a yearly period.

A similar solution to the problem of using the restroom in the dark hours of the night is illustrated in U.S. Pat. No. 5,263,209. In this invention, lights are held under the toilet bowl rim with obtrusive clips and wiring. While this solution provides toilet illumination as required, it also places components in a more obstructive location. Often, water that fills the bowl of a toilet, enters in the area where the light elements reside, and the area is inherently more dirty than the underside of the seat, as it is closer to the fluid in the bowl. This location and the need to clean more frequently in conjunction with the obtrusive appearance and structure is a serious shortcoming.

Additional prior art is included in U.S. Pat. No. 4,860,178 (Picon) which teaches an engageable light. In Picon a powered light source is attached to the toilet and may be switched on by a raising of the seat, or for a person not needing to raise the seat for a bathroom visit, the switch may be activated by hand. A user attempting to locate a still darkened toilet and operating a switch in the dark, is a difficult task for disoriented or fatigued individuals, and as such the Picon device is not well adapted for use in many occasions.

As such, there is a continuing and unmet need for improvement in devices employed in the field of toilet illumination. In particular, there continues a need for an easily installed and highly unobtrusive and gently illuminating device which may be located and uses in restroom facilities in low ambient light environments. Such a device should possess a self-contained power source not requiring AC current, an illuminating means of low power consumption, a secure method to mate the device to the underside of toilet seat such as adhesive or clamping mechanisms, and, an automatic activation feature which causes it to illuminate in low light environments upon user entry to the room. Still further, such a device should have a compact and fluid resistant housing to protect internal components in the potentially wet environment in which it will operate.

The forgoing examples of related art and limitations related therewith are intended to be illustrative and not exclusive, and they do not imply any limitations on the invention described and claimed herein. Various other limitations of the related art are known or will become apparent to those skilled in the art upon a reading and understanding of the specification below and the accompanying drawings.

SUMMARY OF THE INVENTION

The device and method herein disclosed and described achieves the abovementioned goals and cures the noted shortcomings of the prior art, through the provision of a user engageable and multi-modal illuminating device configured to provide a user a safe and convenient illumination device to see in a dark restroom. The device does so while minimizing the potential impact on a user's sleeping cycle relative to the effect of standard bright light fixtures.

The device is configured as an attachable component adapted for operative engagement with conventional toilet seats in one preferred mode. In another mode it may be integrated with a toilet seat in a combination for installation on common toilets.

Several components incorporated into the disclosed illuminating device serve to enhance or improve that primary operation. Such components include a power supply in the form of a battery, a strong adhesive or clamping element, a molded and streamlined enclosure adapted for positioning on a lower surface of a toilet seat, and the inclusion of a plurality of illuminating elements that may be activated under varying conditions which are protected by the enclosure. These varying conditions may include a closed toilet seat orientation, a raised toilet seat orientation and nigh or low levels of ambient light.

Included with the device are the electrical components and the power supply in the form of a commercially available and replaceable battery. The electrical components are powered by the onboard battery and include illuminating elements in the form of light emitting diodes (LED's) which are switched on or off through means for activation which includes a microphone, and/or a photosensor element and/or an orientation switch.

The photosensor provides a switch to energize the device for operation in the event of low ambient light in the room, thereby activating light emitting diodes operatively engaged thereto. The preferred orientation switch is employable to activate secondary light emitting diodes engaged within the device which illuminate directionally in the direction of the toilet bowl and floor supporting it, while the seat positioned to a lifted position. The orientation switch also will turn off LEDs or lighting components which might illuminate in the direction of the toilet user's eyes when the seat to which the device is engaged is in the elevated or vertical position.

When the seat positioned to a lowered state with a bottom surface supported upon the bowl, the orientation switch is configured to deactivate the respective light emitting diodes which previously illuminated toward the toilet bowl while the seat was raised, and to cause illumination of other illumination means adapted for the lowered position. Depending on the particular embodiment installed, the orientation switch may act as a selector switch that only allows a fraction of the plurality of light emitting diodes to be illuminated based on the orientation of the device and toilet seat it is attached to.

A microphone may also be included in a means for activation whereby the sound of footsteps, or the noise generated by a user entering the bathroom, will be sensed and thereby cause an illumination of some of the illuminating components such as LEDs upon entry. Such allows the user to gain their bearings in a darkened room.

The exterior housing of the device is formed of a molded plastic or a material of similar construction allowing the formation of an electronics compartment within the housing wall. The wall of the housing in the electronics compartment exterior area may be transparent, semi-transparent and filtered, slotted or possess apertures for directing the light emitted from the LEDs to escape and or be focused and directed toward an intended target of illumination.

Also, one exterior of the housing of the device is a substantially planar or flat surface area which may include a coating or attachment of a strong adhesive section. This planar surface and adhesive is intended to be mated to the planar underside of a toilet seat during installation. Other embodiments of the device may include mating interfaces may consist of a clamping mechanism to provide the mating biasing, a screw assembly for permanent installation and mating, or an integrated installation where the device is embedded within a toilet seat.

Means for illumination in the form of light emitting diodes (LED's) of the device may have a color filtered exterior surface to alter the wavelength of the light escaping from the device, thereby altering the perceived color thereof by a user. Alternatively the LED's themselves can be made in a manner to emit one or a plurality of differing colored light depending on switching or voltage communicated to the individual LED's.

One such color of light the device may be configured to emit is red which has been shown to preserve the night vision characteristics of human eyesight and the benefit it provides the eyes in dark environments. The color filter it employed, may be interchangeable based on user preference if it is present.

Other options to change the color emitted from the device is to have light emitting diodes of specific colors, to have an array of different light emitting diodes of differing colors that a user or the switch may select, or as noted, to have multicolor light emitting diodes which emit a varying range of colors as directed by a built-in micro-controller, or voltage communicated thereto.

The control of the light emitting diodes relative to orientation may be controlled through an orientation switching means. Such a switch may be an accelerometer, or a tilt sensor element such as a mercury switch, that activates illumination components based on the current or changed orientation of the device. Such a change may be on a scale of ninety degrees in orientation change, where positioning at zero degrees would be a closed toilet seat in a horizontal position supported by the bowl, and positioning at or close to ninety degrees where the seat is vertically inclined and supported on a hinge engaged to the bowl.

The photosensor control or switch of the device is configured to detect ambient light in the surrounding area such as daylight or bathroom lights being illuminated. The photosensor will in such instances act as a switch to disable the illumination of any of the components of the device if significant ambient light is present at a sufficient level to cause the photosensor to switch. The photosensor should not be activated by the illumination of the device's own light emitting diodes. To combat the issue of light pollution from the light emitting diodes, a color specific photosensor may be employed that excludes the wavelength emitted by the illuminated light emitting diodes of the device, but would be sensitive to ambient multicolor lighting. The photosensor can also be of a type which must have illumination at a particular threshold in lumens before switching to connect or disconnect the circuit.

Other embodiments of the device may include light emitting diodes that will energize for defined periods of time, to project ultraviolet light into the toilet bowl area. Such a wavelength is known to provide germicidal benefits and improve the sanitation of the toilet area through ultraviolet disinfection. Such can be accomplished by a timer or software running on a computing processor and in memory of the device to cause such illumination on a schedule.

Further modes of the device may also include light signals discernable by the user in the form of colors or light direction to act as a signal a user that the seat is already lifted to the elevated position, or is currently lowered to the horizontal position. This positional signaling allows for users to ascertain a seat orientation in dark environments without needing to use their body feel around and contact a possibly unsanitary area. One such example may be the device shining red or blue to signal a positioning of the seat being elevated, and pink or green to provide a visual signal of the seat being in the horizontal position, thereby signaling the status of seat in extremely dark environments to people who may have just awakened. In certain households there are preferences as to positioning the orientation of the seat after use by a user, and this device may provide a subtle reminder to return the seat to its preferred state. An audible or visible alarm may he provided to a user after a defined period of time after use ceases, to return the seat to the default position if it has not been so returned.

In addition to activation by motion of the toilet seat, the device may be activated by a sound and/or vibration sensor or an infrared sensor, any or all of which may be employed to cause the device to sense user entry into the bathroom. Such will allow the device to immediately illuminate on entry from sound or sensing of body heat, and for users not requiring a raised seat, the illumination would signify the current orientation of the seat as the case may be. A timer may be engaged with the system to turn off the illumination in the event that the seat is left raised or for other reasons the light remains illuminated for more than a few minutes.

It is an object of this invention to provide a toilet illumination device adapted for minimally impacting the night vision and sleeping patterns of users who need to locate the toilet in low light situations, particularly when awakening in the night.

It is a further objective of this device to provide such a light source which is sufficiently compact and easily engageable to a lower surface of a conventional toilet seat while also providing a low energy solution to locating the toilet in low light situations.

These together with other objects and advantages which become subsequently apparent reside in the details of the construction and operation as more fully hereinafter described and claimed, reference being had to the accompanying drawings forming a part thereof, wherein like numerals refer to like parts throughout.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

DETAILED DESCRIPTION OF THE PREFERRED EMBODIMENTS OF THE INVENTION

Figure 1:
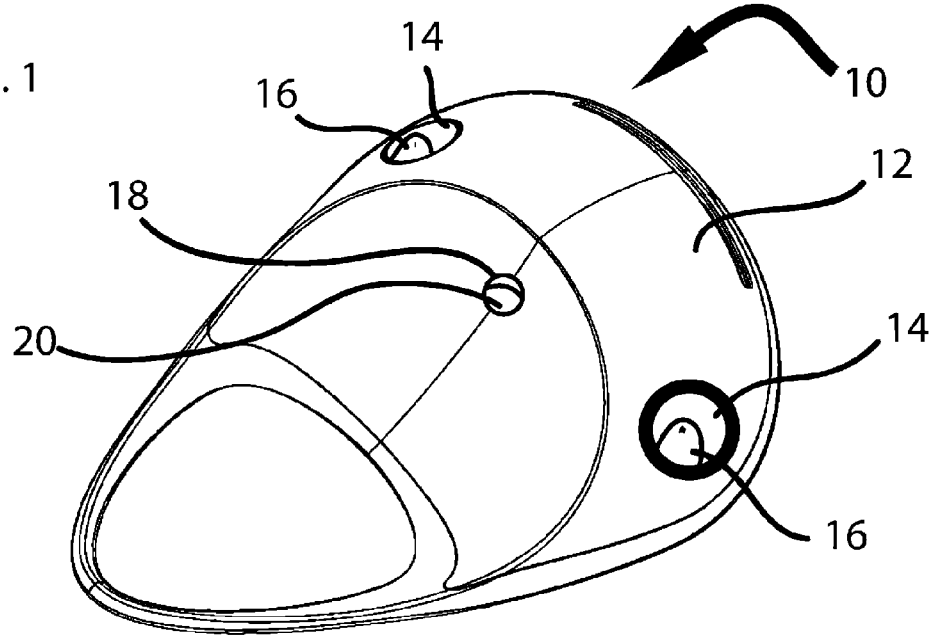
FIG. 1 depicts a perspective exterior view of the device with light emitting diode apertures.

Referring now to the drawings of FIGS. 1-8 are the modes of the device 10 employed for the illumination of toilets and proximal room areas in dark or low ambient light environments.

In FIG. 1, a perspective view of one embodiment of the illumination device 10 is shown. The device 10 includes an exterior molded housing 12 which is sealed from moisture entering an internal cavity, that is shown in this mode as being opaque with LED apertures 14 sized for light to emit from the housing 12 from the LEDs 16 engaged in the apertures 14 or within a cavity defined by the housing 12 and adjacent the apertures 14. Also on this surface of the wall defining the housing 12 is shown a photosensor aperture 18 that communicates ambient light to enter the housing for detection by the sensor 20. The sensor 20 may also be or include an infrared sensor and/or vibration sensor and/or a microphone as a sensor configured to ascertain entry of a user to the room where the device 10 is located and to act as or activate a switch to cause the device 10 to illuminate.

Configured as an ambient light sensor, if significant ambient light above a preset threshold is detected by the sensor 20, the device can be given an output electronic signal to deactivate the means for illumination from any connection to power, or act as a switch itself if configured to do so, and to make this disconnect irrespective of a trigger to illuminate caused by a sensor 20 for one or a combinaton of sound, vibration, or body heat, or infrared light.

Figure 2:
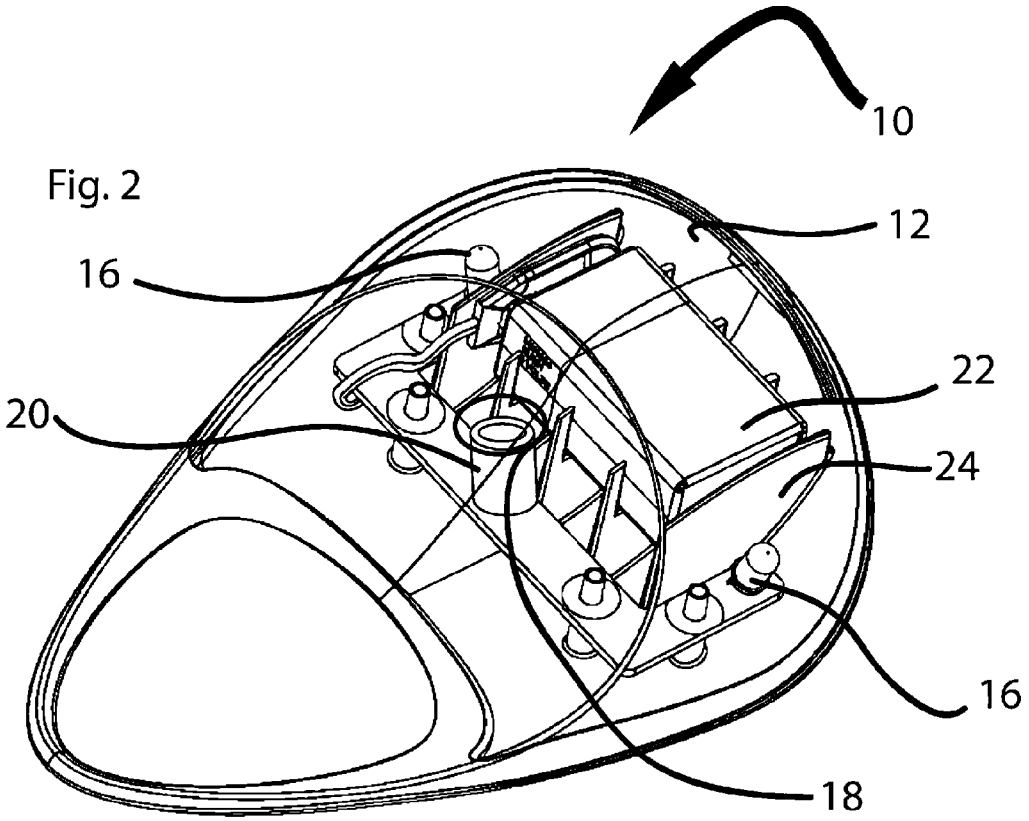
FIG. 2 depicts a perspective view of the device showing the internal electronic components and operatively engaged light emitters as might be viewed with a transparent housing.

FIG. 2 illustrates the same device 10 a semi transparent exterior molded housing 12 or portion thereof, that allows light from the LEDs 16 positioned within the housing 12 or apertures 14 therein, to pass while diffusing the emitted light and making it appear softer to viewers. This exterior molded housing 12 in the transparent or semi transparent areas, may be tinted in a color such as red to filter the light into a more pleasant color for viewing in dark environments. Seen through the transparent area of the exterior molded housing 12 in this figure, is also the onboard electric power supply 22 in the form of a battery. Also shown are the power supply mounts 24, and a better view of a sensor 20 of one or all of the aforementioned types, and LEDs 16.

Figure 3:
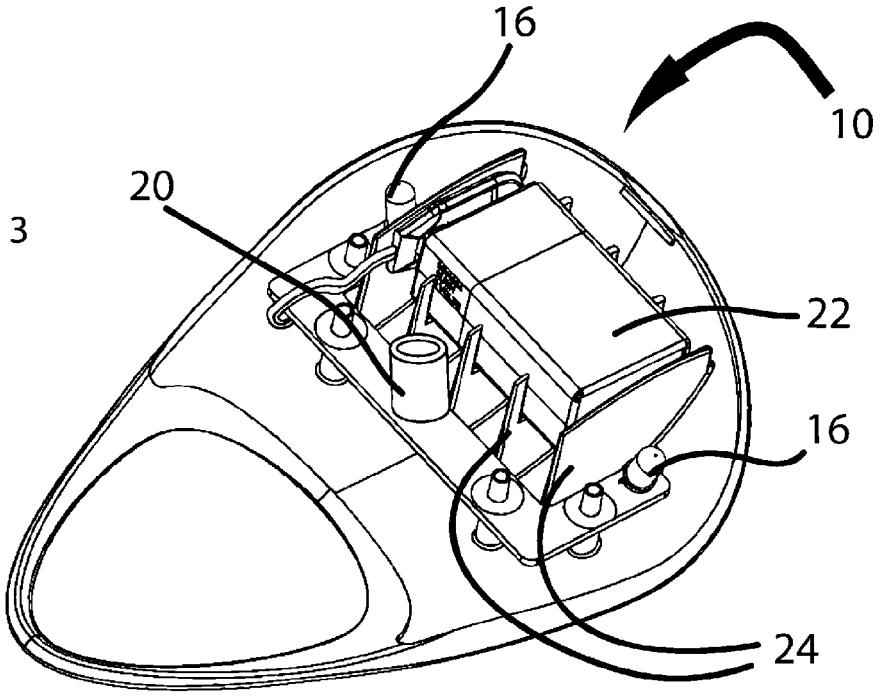
FIG. 3 depicts an internal perspective view of the device's electrical components.

FIG. 3 further illustrates the internal electronic components of the illuminating device 10 with the removal of a curved portion of the wall forming the exterior housing 12. These components can include a microprocessor and electronic memory engaged thereto if the device 10 includes a computer and software running thereon in electronic memory to activate the various lighting schemes noted herein.

Figure 4:
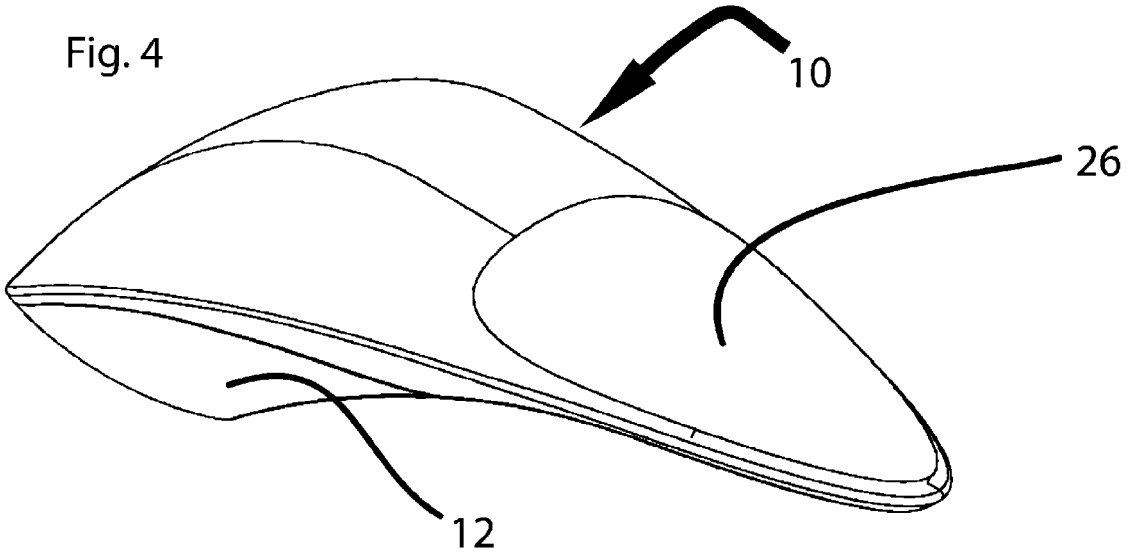
FIG. 4 depicts a perspective view from the planar mounting surface side of the device illustrating the adhesive mating area positioned thereon.
Figure 8:
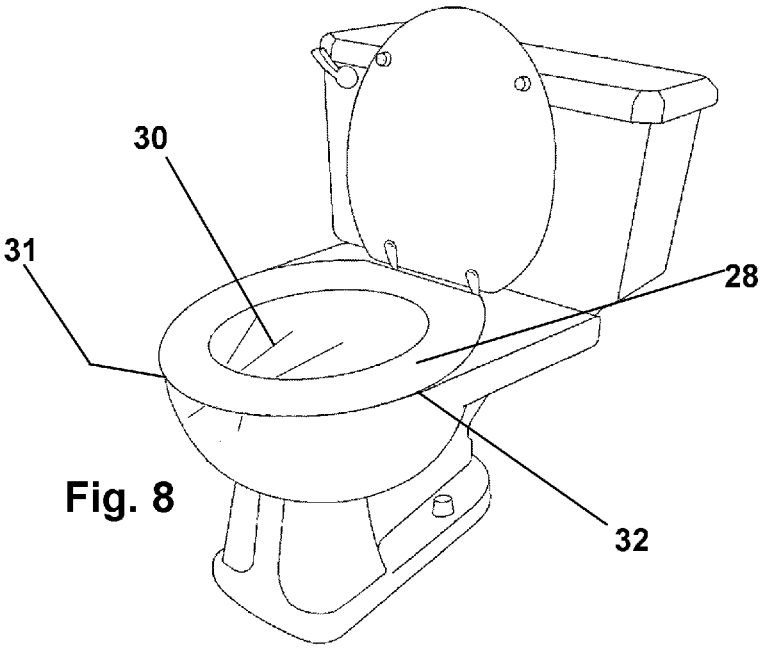
FIG. 8 depicts operation of the device positioned on the bottom of a toilet seat in the horizontal position supported on the bowl.

FIG. 4 depicts the mating surface area for a fastener 26 on a planar area of a surface of the housing 12 of the device 10 opposite the curved portion removed in FIG. 3. In this mode the mating surface and fastener 26 itself, is substantially planar or flat and thereby adapted to engage the conventionally planar underside of toilet seat 28. The housing 12 is of a thickness between the curved side and planar area to fit in-between the seat 28 and the upper surface of the toilet bowl, with the seat 28 in the horizontal position, such as shown in FIG. 8, which is no wider than an inch between the bottom planar surface of the seat 28 and top planar annular surface of the toilet bowl 32 which surrounds the water holding area thereof.

A preferred fastener 26 for the device 10 to a toilet seat 28 is provided which as shown may be a strong, waterproof and solvent resistant adhesive, or hook or loop fabric configured to engage the complimentary half thereof which is adhered on the seat 28. Other fasteners 26 for the device 10 to the seat 28 may be clips, clamps or screws in place of the adhesive or hook and loop fabric.

Figure 5:
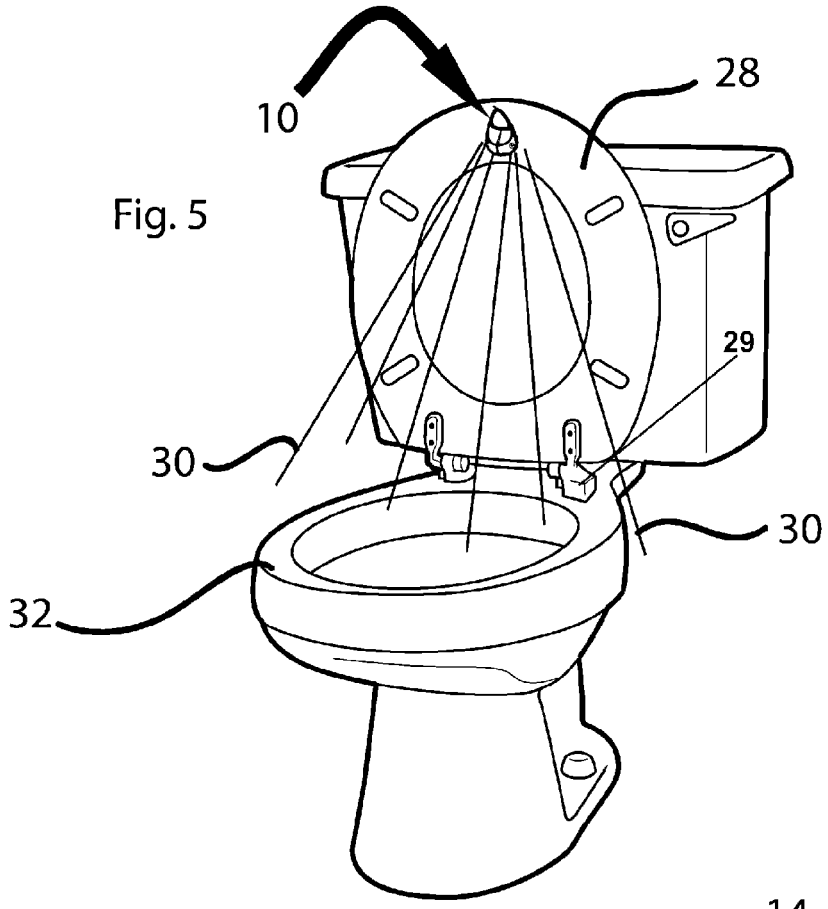
FIG. 5 depicts a perspective view of the device illuminating a toilet with an open or vertically inclined toilet seat orientation.

In FIG. 5 the device 10 is shown to be mated to a toilet seat lid 28, in a mounted position at a position on the planar surface of the toilet seat 28 positioned at the opposite end of the seat 28 from the hinges 29 engaging it to the bowl 32. When the device 10 is activated, sensors 20 cause switching to an energized state of LED's positioned on the device 10 to project light 30 onto the toilet bowl 32, its interior and its surroundings.

In this elevated orientation, employing a tilt sensor switch 34 and a second set of LEDs 36, the tilt sensor switch 34 will deactivate the LEDs 16 that face, and emit light away from the toilet bowl 32, with the seat 28 in the elevated position, which might emit light into the user's line of sight to prevent disorientation of the user.

These LED's 16 would however be energized with the seat 28 in the horizontal orientation, as in FIG. 8 to emit light toward the bowl 32, taking advantage of the reflective nature of porcelain from which the bowl 28 is generally formed, which will deflect received light therefrom and illuminate the interior of the bowl 28 and areas around it in the room. The second set of LED's 36 may be turned of by the position sensor switch or left illuminated since the device 10 is out of direct line of sight with the seat 28 in the horizontal position of FIG. 8.

Figure 6:
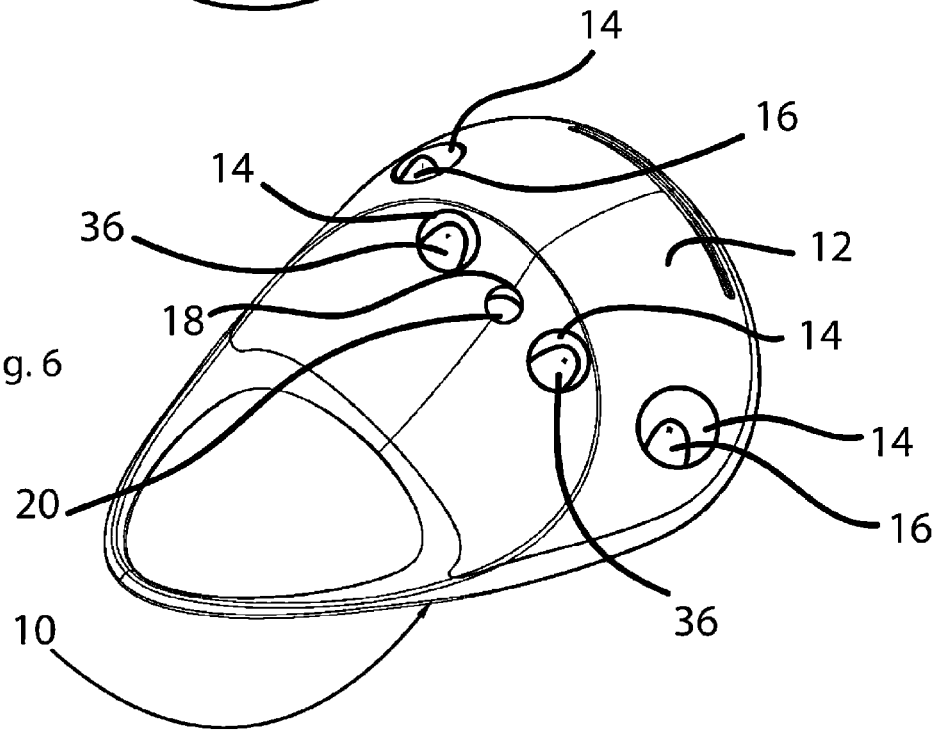
FIG. 6 depicts a perspective view of the device with separate light emitting diodes intended for vertical and horizontal toilet seat positioning operation.
Figure 7:
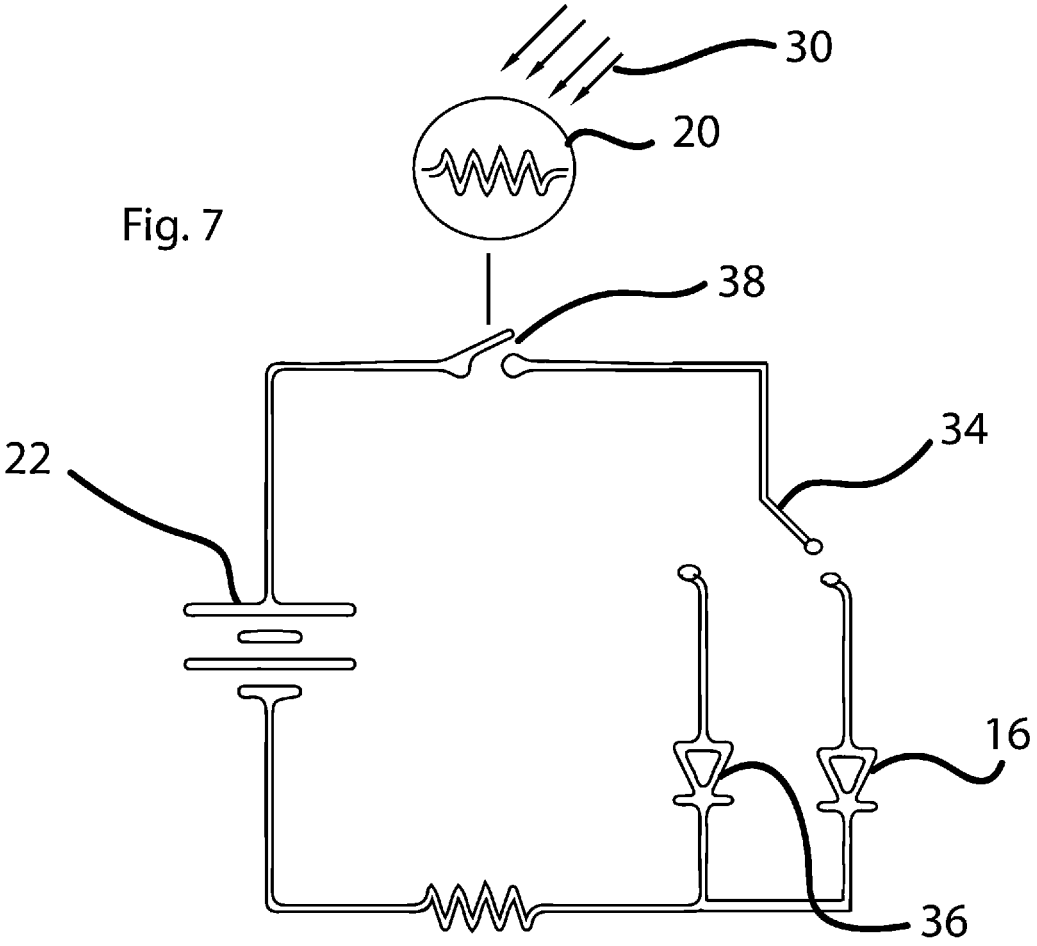
FIG. 7 illustrates the electrical configuration of the device.

FIGS. 6 and 7 further illustrate the presence of a second set of LEDs 36 that will be activated when the toilet seat lid 28 is lifted vertically and the tilt sensor activates. In this orientation, the original LEDs 16 may de-energize by the action of the same tilt sensor switch 34. In the FIG. 7 diagram, the tilt sensor switch 34 acts as a selector switch between the original LEDs 16 and the second set of LEDs 36. Also, more clearly shown here, is the relationship of the sensor 20 and the device 10 operation. When the sensor 20 receives light past its tripping threshold, or sound, if a sensor 20 for sound is used, or both, it causes closure of a main switch 38 on or connected to the sensor 20, and activates the device 10. In the same fashion a sensor 20 for vibration, a microphone sensor 20 for sound, or a light sensor 2*u* configured to sense infrared light can be employed to close a switch to illuminate at least some illumination components on the device 10.

Depending on the orientation of the device 10, a specific set of LEDs 16 will illuminate due to the tilt sensor switch which can also deactivate other LEDs which might contact the user's eyesight negatively. The device is powered by a power supply 22 in the form of a user replaceable and in some embodiments rechargeable battery.

As noted, FIG. 8 depicts operation of the device 10 positioned on the bottom of a toilet seat 28 which is oriented in the horizontal position, supported on the toilet bowl 32. Light 30 can be projected from the device 10 in multiple directions through the gap 31 defined by the are between the planar surface of the seat 28 on which the device 10 engages, and the planar upper surface of the toilet bowl 32.

Finally, as noted LED's 16 or 36 can be included with will emit Ultra Violet light from the device 10. Such is know to disinfect surfaces where such UV light strikes. The UV light can be caused to emit from the device 10 at timed intervals or for durations after cessation of use of the toilet is sensed, to thereby help disinfect the toilet bowl.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A toilet illuminating apparatus adapted for engagement to a toilet seat positionable between a horizontal position adjacent a top surface of a toilet bowel and a vertical position extending vertically from hinges engaged between a first end of said toilet seat and the toilet bowl, said illuminating apparatus comprising:

a housing having an interior cavity surrounded by a planar side surface opposite a second side surface;

a fastener for engaging said planar side surface to a planar surface of said toilet seat at a second end thereof opposite said first end, said planar surface of said toilet seat positioned across a gap from an upper surface of said toilet bowl with said toilet seat in said horizontal position;

a first light emitter engaged with said housing;

an electric power source for communicating electric power to said first light emitter;

said first light emitter projecting light in a direction away from said second side of said housing, when placed in a connection to said electric power source;

an ambient light sensor, said ambient light sensor opening said connection of said electric power source to said first light emitter when ambient light at or higher than a preset threshold is sensed;

at least one secondary sensor, said secondary sensor configured for detecting one or a combination of triggers from a group of triggers including sound, body heat, infrared, and vibration;

said secondary sensor placing said light emitter in said connection to said power source upon detecting said trigger; and whereby said toilet illuminating apparatus upon a sensing of a said trigger by said sensor emits said light away from said housing, unless said ambient light at or past said threshold is sensed by said ambient light sensor.

2. The toilet illuminating apparatus of claim 1 wherein said light emitted is in a red or green spectrum.

3. The toilet illuminating apparatus of claim 1 wherein first light emitter is positioned within or adjacent an aperture communicating into said second side of said housing, whereby said first light emitters projects said light in said direction away from said second side of said housing, through said aperture.

4. The toilet illuminating apparatus of claim 2 wherein first light emitter is positioned within or adjacent an aperture communicating into said second side of said housing, whereby said first light emitters projects said light in said direction away from said second side of said housing, through said aperture.

5. The toilet illuminating apparatus of claim 1 additionally comprising:

a second light emitter, said second light emitter projecting light in a direction away from said second side of said housing, when placed in a second connection to said electric power source;

an orientation sensor, said orientation sensor determining whether said toilet seat is in said horizontal or said vertical position;

said orientation sensor placing said second light emitter in said second connection to said electric power source when sad toilet seat is in said vertical position;

said second light emitter configured to emit said light in a direction away from said second side of said housing, only at a declining angle toward said toilet bowl;

said orientation sensor causing a said opening said connection of said electric power source to said first light emitter when said toilet seat is sensed in said vertical position; and whereby said light emitted from said housing is emitted at said downward angle away from the head of a user adjacent to said toilet bowl thereby preventing a direct communication of said light to eyes of said user.

6. The toilet illuminating apparatus of claim 2 additionally comprising:

a second light emitter, said second light emitter projecting light in a direction away from said second side of said housing, when placed in a second connection to said electric power source;

an orientation sensor, said orientation sensor determining whether said toilet seat is in said horizontal or said vertical position;

said orientation sensor placing said second light emitter in said second connection to said electric power source when sad toilet seat is in said vertical position;

said second light emitter configured to emit said light in a direction away from said second side of said housing, only at a declining angle toward said toilet bowl;

said orientation sensor causing a said opening said connection of said electric power source to said first light emitter when said toilet seat is sensed in said vertical position; and whereby said light emitted from said housing is emitted at said downward angle away from the head of a user adjacent to said toilet bowl thereby preventing a direct communication of said light to eyes of said user.

7. The toilet illuminating apparatus of claim 3 additionally comprising:

a second light emitter, said second light emitter projecting light in a direction away from said second side of said housing, when placed in a second connection to said electric power source;

an orientation sensor, said orientation sensor determining whether said toilet seat is in said horizontal or said vertical position;

said orientation sensor placing said second light emitter in said second connection to said electric power source when sad toilet seat is in said vertical position;

said second light emitter configured to emit said light in a direction away from said second side of said housing, only at a declining angle toward said toilet bowl;

said orientation sensor causing a said opening said connection of said electric power source to said first light emitter when said toilet seat is sensed in said vertical position; and whereby said light emitted from said housing is emitted at said downward angle away from the head of a user adjacent to said toilet bowl thereby preventing a direct communication of said light to eyes of said user.

8. The toilet illuminating apparatus of claim 4 additionally comprising:

a second light emitter, said second light emitter projecting light in a direction away from said second side of said housing, when placed in a second connection to said electric power source;

an orientation sensor, said orientation sensor determining whether said toilet seat is in said horizontal or said vertical position;

said orientation sensor placing said second light emitter in said second connection to said electric power source when sad toilet seat is in said vertical position;

said second light emitter configured to emit said light in a direction away from said second side of said housing, only at a declining angle toward said toilet bowl;

said orientation sensor causing a said opening said connection of said electric power source to said first light emitter when said toilet seat is sensed in said vertical position; and whereby said light emitted from said housing is emitted at said downward angle away from the head of a user adjacent to said toilet bowl thereby preventing a direct communication of said light to eyes of said user.

9. The toilet illuminating apparatus of claim 1 wherein said housing has a width between said planar side surface opposite said second side surface of less than one inch whereby said housing will fit in a gap formed between said toilet seat and said toilet bowl with said toilet seat in said horizontal position.

10. The toilet illuminating apparatus of claim 4 wherein said rousing has a width between said planar side surface opposite said second side surface of less than one inch whereby said housing will fit in a gap formed between said toilet seat and said toilet bowl with said toilet seat in said horizontal position.

11. The toilet illuminating apparatus of claim 8 wherein said housing has a width between said planar side surface opposite said second side surface of less than one inch whereby said housing will fit in a pap formed between said toilet seat and said toilet bowl with said toilet seat in said horizontal position.

* * * * *